US012383057B2

(12) United States Patent
Beck et al.

(10) Patent No.: US 12,383,057 B2
(45) Date of Patent: Aug. 12, 2025

(54) KNOCKDOWN BRACING FOR SHELVING UNIT END FRAME

(71) Applicant: LL&T International, LLC, Knoxville, TN (US)

(72) Inventors: Todd Beck, Knoxville, TN (US); Lam Lam Ly, Ho Chi Min (VN)

(73) Assignee: LL&T INTERNATIONAL, LLC, Knoxville, TN (US)

( * ) Notice: Subject to any disclaimer, the term of this patent is extended or adjusted under 35 U.S.C. 154(b) by 0 days.

(21) Appl. No.: 18/520,941

(22) Filed: Nov. 28, 2023

(65) Prior Publication Data

US 2025/0017365 A1 Jan. 16, 2025

Related U.S. Application Data

(60) Provisional application No. 63/526,725, filed on Jul. 14, 2023.

(51) Int. Cl.
*A47B 47/02* (2006.01)

(52) U.S. Cl.
CPC ..... *A47B 47/028* (2013.01); *A47B 47/027* (2013.01)

(58) Field of Classification Search
CPC ... A47B 47/028; A47B 47/0083; A47B 43/00; A47B 47/0066; A47B 47/0075; A47B 47/027
USPC ..... 211/186, 149, 195
See application file for complete search history.

(56) References Cited

U.S. PATENT DOCUMENTS 2,604,213 A * 7/1952 Bales ..... A47B 57/482 52/762
2,918,176 A * 12/1959 Bell ..... A47B 47/027 211/187
3,194,407 A * 7/1965 D Altrui ..... A47B 45/00 108/106
3,221,894 A * 12/1965 Knuth ..... A47B 57/30 211/187
3,625,372 A * 12/1971 MacKenzie ..... A47B 57/402 211/191
3,647,080 A * 3/1972 Denny ..... A47B 47/027 108/901

(Continued)

FOREIGN PATENT DOCUMENTS

EP 1151695 A1 * 11/2001 ..... A47B 47/027

*Primary Examiner* — Jennifer E. Novosad
(74) *Attorney, Agent, or Firm* — Shook Hardy & Bacon L.L.P.

(57) ABSTRACT

A four-column shelving unit with knockdown bracing running between the front and rear columns to form an end frame. The shelving unit comprises end frames formed by connecting a front column and a rear column to each other with knockdown bracing. The knockdown bracing may comprise a diagonal knockdown brace, a top knockdown brace, and a bottom knockdown brace. The knockdown bracing transitions from the knockdown state to the assembled state by pivoting on a hinge that connects one end of the bracing to the column. To complete assembly a pivot screw or other connector may be used to secure the unhinged end of the knockdown bracing to the opposite column. In an aspect, the top and bottom knockdown bracing are hinged within a first column, while the diagonal knockdown bracing is hinged within the second column.

18 Claims, 10 Drawing Sheets

(56) References Cited

U.S. PATENT DOCUMENTS 4,030,612 A * 6/1977 Gray ..... F16B 12/32 403/321
4,088,229 A * 5/1978 Jacoby ..... A47B 91/00 211/183
4,262,809 A * 4/1981 McConnell ..... A47B 57/50 403/317
5,012,938 A * 5/1991 King ..... A47B 57/18 211/182
5,263,296 A * 11/1993 Spera ..... E04G 11/48 52/646
6,604,640 B1 * 8/2003 Jehin ..... A47B 47/027 52/167.3
7,748,546 B2 * 7/2010 Konstant ..... A47B 47/021 52/693
8,172,098 B2 * 5/2012 Eustace ..... A47B 57/22 211/189
8,302,788 B2 * 11/2012 Vargo ..... A47B 57/50 211/186
8,403,157 B2 * 3/2013 Kleinsasser ..... A47B 47/027 403/49
9,924,797 B2 * 3/2018 Hanlon ..... A47B 47/0083
10,506,880 B2 * 12/2019 Hanlon ..... A47B 47/028
10,974,352 B1 * 4/2021 Klinger ..... B23P 6/00
11,690,446 B2 * 7/2023 Harrison ..... A47B 47/021 211/153
2008/0173603 A1 * 7/2008 Dion ..... A47F 5/00 211/182
2011/0278251 A1 * 11/2011 Smith ..... A47F 5/01 211/183
2014/0353271 A1 * 12/2014 Kruse ..... A47F 5/01 211/188
2015/0090683 A1 * 4/2015 Sabounjian ..... A47B 96/14 211/186
2020/0165064 A1 * 5/2020 Harrison ..... B65G 1/02
2025/0017365 A1 * 1/2025 Beck ..... A47B 47/028

* cited by examiner

KNOCKDOWN BRACING FOR SHELVING UNIT END FRAME

CROSS-REFERENCE TO RELATED APPLICATIONS

This application claims the benefit of U.S. Provisional Application No. 63/526,725, filed Jul. 14, 2023, and titled "Knockdown Bracing for Shelving Unit End Frame", the entirety of which application is hereby incorporated by reference.

BACKGROUND

Shelving units comprising vertical corner columns, horizontal shelf beams, tie bars, and shelves supported by the beams are known. Existing shelving units are designed to withstand heavy loads without significant deformation. Existing shelving units are also designed to be relatively lightweight and easy to assemble and disassemble. The materials of construction, component size, and component design work together to maximize load capacity, lower the unit weight, and decrease the assembly difficulty. These design factors are often in tension with each other. For example, a lighter unit may be achieved by using thinner structural members. But, in general, the use of thinner members, assuming the same material of construction (e.g., steel or aluminum), may decrease the maximum load capacity. Increasing the load capacity may also decrease the ease of assembly, because, if nothing else, heavier components may be more difficult to manipulate during assembly and could even require mechanical assistance, such as rigging. In addition, heavier components may require more complex mechanisms to connect the beams, columns, shelves and bracing. In some cases, it may be desirable for two lighter weight components to be connected during assembly, rather than assembling fewer, but heavier components.

Assembly difficult may be measured in the amount of time needed to assemble a unit, amount of people needed to assemble a unit, tools needed to assemble the unit and mechanical skill needed to assemble. An increased precision of fit and overall alignment precision needed to connect different pieces may increase assembly difficulty. It is desirable to improve ease of assembly, by decreasing the tools needed, mechanical skill needed, and time taken to assemble a unit. It is also desirable to increase the ease of assembly by providing components that have greater alignment leeway during assembly. An objective of this invention is to provide a shelving unit that may be shipped in a disassembled state and easily assembled into a structurally sound shelving unit.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The technology described herein includes a four-column shelving unit with front and rear shelf-support beams running between two front columns and two back columns. The knockdown bracing of the present technology provides safer and easier assembly of the shelving unit. The knockdown bracing runs between the front and rear columns to form an end frame. The four-column shelving unit comprises a right-side end frame and a left-side end frame. The end frames are connected by the front and rear shelf-support beams. The end frame is formed by a front column and a rear column connected by knockdown bracing.

The knockdown bracing may comprise a diagonal knockdown brace, a top knockdown brace and a bottom knockdown brace. In an assembled state, the diagonal knockdown brace runs between the front and back columns at an angle, such as 20 degrees, 30 degrees, 40 degrees, or 45 degrees. In an assembled state, the top knockdown brace and bottom knockdown brace are substantially perpendicular to the front and rear columns. In a knock down state, the knockdown bracing will be parallel with the column and interior to the column. The knockdown position is the unassembled position in which the column may be shipped and/or packaged and shipped.

The bracing transitions from the knockdown state to the assembled state by pivoting on a hinge that connects the bracing to the column. To complete assembly a pivot screw or other connector may be used to secure the unhinged end to the opposite column. The bracing may be formed of a C-channel with an exterior width that is less than the interior width of the partial enclosure formed by the column, which may also be a made from a C-channel.

BRIEF DESCRIPTION OF THE DRAWINGS

The technology described herein is illustrated by way of example and not limitation in the accompanying figures in which like reference numerals indicate similar elements and in which.

DETAILED DESCRIPTION

Figure 1:
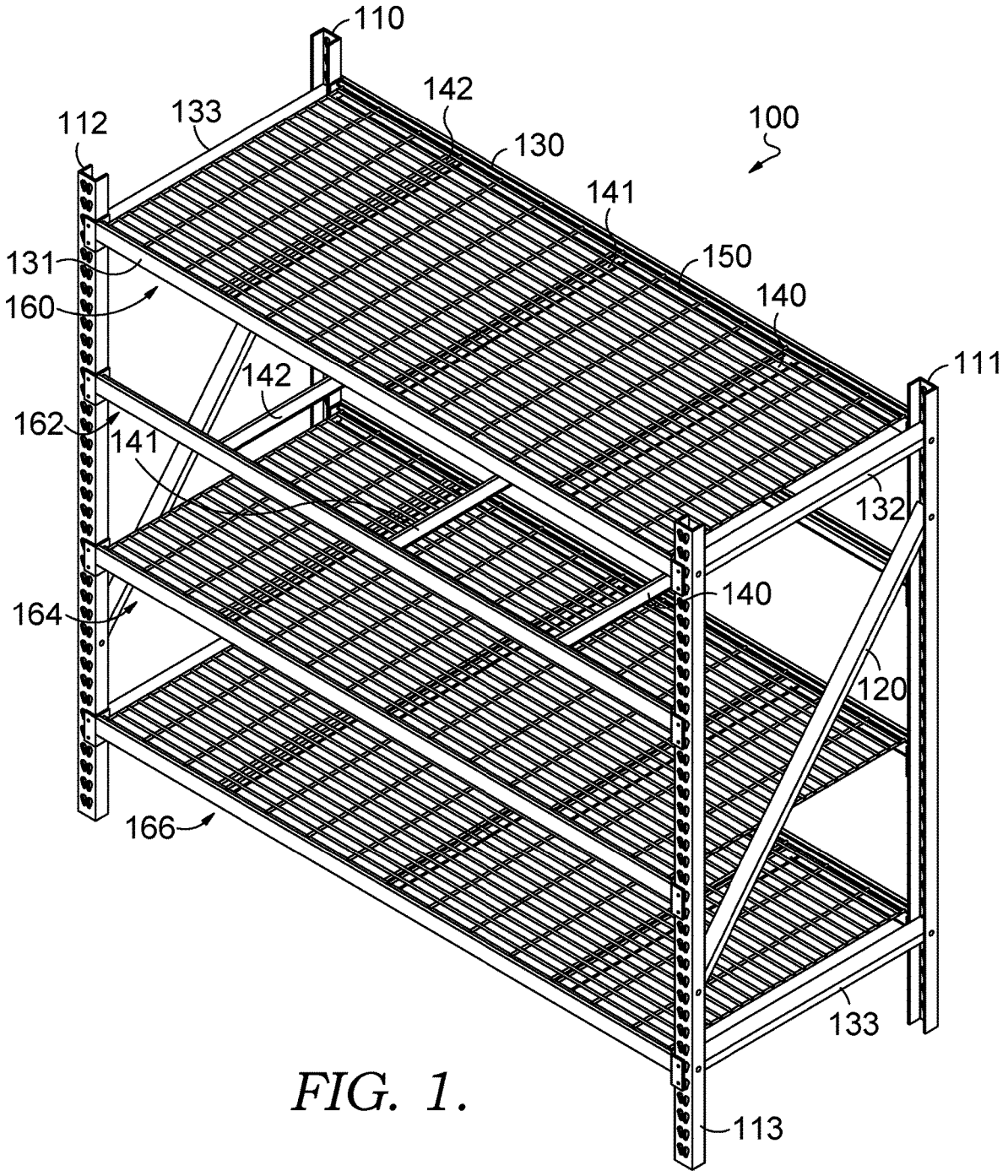
FIG. 1 is a perspective view of a shelving unit, in accordance with aspects of the present disclosure.

The various technologies described herein are set forth with sufficient specificity to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

The technology described herein includes a four-column shelving unit with front and rear shelf-support beams running between two front columns and two back columns. The knockdown bracing of the present technology provides safer and easier assembly of the shelving unit. The knockdown bracing runs between the front and rear columns to form an end frame. The four-column shelving unit comprises a right-side end frame and a left-side end frame. The end frames are connected to each other by the front and rear shelf-support beams. The technology described herein forms an end frame by connecting a front column and a rear column to each other with knockdown bracing.

The knockdown bracing may comprise a diagonal knockdown brace, a top knockdown brace, and a bottom knockdown brace. In an assembled state, the diagonal knockdown brace runs between the front and back columns at an angle, such as 20 degrees, 30 degrees, 40 degrees, or 45 degrees. In an assembled state, the top knockdown brace and bottom knockdown brace are substantially perpendicular to the front and rear columns. In a knock down state, the knockdown bracing will be parallel with the column and interior to the column. The knockdown position is the unassembled position in which the column may be shipped and/or packaged and shipped.

The bracing transitions from the knockdown state to the assembled state by pivoting on a hinge that connects one end of the bracing to the column. To complete assembly a pivot screw or other connector may be used to secure the unhinged end of the knockdown bracing to the opposite column. The knockdown bracing may be formed of a C-channel with an exterior width that is less than the interior width of the partial enclosure formed by the column, which may also be a made from a C-channel.

In an aspect, the top and bottom knockdown bracing are hinged within a first column, while the diagonal knockdown bracing is hinged within the second column. The first column could be the front column and the second column the back column. Or the first column could be back column and the second column the front column. The top knockdown bracing and the bottom knockdown bracing are connected to the column at points that allow both braces to fold into the column without interfering with each other. The top knockdown bracing and the bottom knockdown bracing may have the same dimensions, including the length.

Having briefly described an overview of aspects of the technology described herein, an exemplary operating environment in which aspects of the technology described herein may be implemented is described below in order to provide a general context for various aspects.

Turning now to FIG. 1, a perspective view of a shelving unit 100 that includes the end frame with knock down bracing is provided. The shelving unit 100 comprises four vertical columns (110, 111, 112, and 113) located in each corner of the shelving unit 100. The four vertical columns include a back-left column 110, a back-right column 111, a front-left column 112, and a front-right column 113. The bottom of the vertical columns (110, 111, 112, and 113) rest on a floor or other support surface. The purpose of the vertical columns is to transfer a load on the shelves to the floor support surface. The four vertical columns (110, 111, 112, and 113) may be substantially identical, except that two will contain a diagonal knockdown brace and two will contain a top knockdown brace and a bottom knockdown brace. The end frame is formed by pairing one column of each type. Once the end-frame is assembled, the end frame may be positioned in either direction. The interchangeable orientation of the vertical columns means the location designations (e.g., front right, back left) given them in this description may be relative locations determined during assembly, rather than absolute locations.

The vertical columns (110, 111, 112, and 113) are shown as C-channels (alternatively described as U-channels). Embodiments of the technology described herein are not limited to vertical columns taking the form of a C channel. In alternative embodiments, the vertical columns may be tubular, L-beams, I-beams, or take some other suitable form. A face of the vertical columns (110, 111, 112, and 113) comprises apertures, which serve as a connection point for the horizontal shelf-support beams 130 and 131. Pins in the backside of the shelf-support beams may slide into the apertures. The knock-down bracing shown includes a diagonal knockdown brace 120, a top knockdown brace 132, and bottom knockdown brace 133.

The shelving unit 100 includes four shelves 160, 162, 164, 166. Each shelf comprises a front shelf-support beam 131 and a back shelf-support beam 130. One or more tie bars (140, 142, and 144) may run between the front shelf-support beam 131 and back shelf-support beam. Three tie bars are shown in FIG. 1, but embodiments are not limited to use with three tie bars. For example, one, two, three, four, five or more tie bars may be used. The tie bars (140, 142, and 144) can help support the shelf medium 150 and provide stability to the individual shelf and the overall shelving unit 100. In the embodiment shown, the shelf medium 150 is a grate. However, aspects the technology described herein are not limited to grating. Other type of shelf mediums, such as plywood, plastic, steel sheeting, and the like may be used. For sake of viewing the tie bars clearly, the second shelf 162 is shown without a shelf medium.

Figure 2:
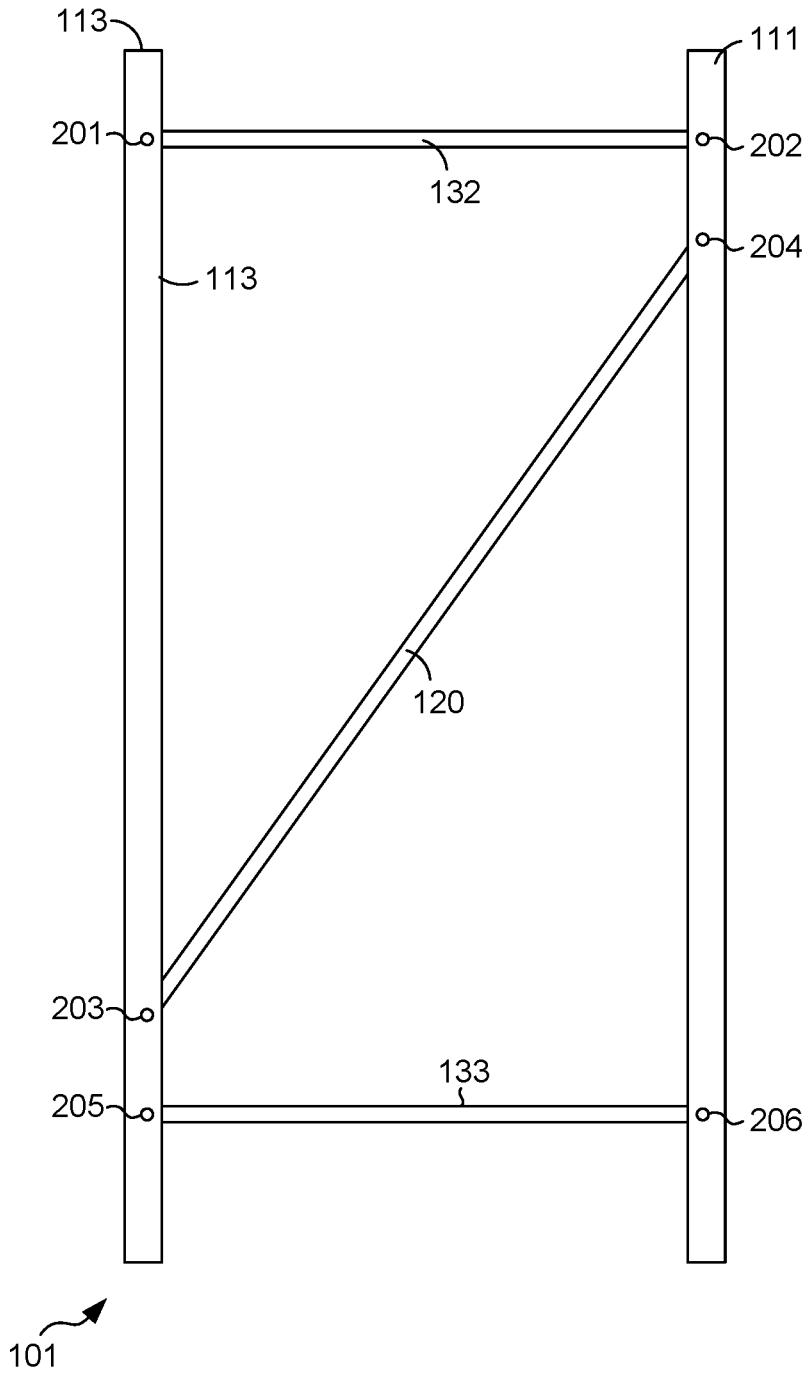
FIG. 2 is a front view of an assembled end frame, in accordance with aspects of the present disclosure.

Turning now to FIG. 2, a front view of an assembled end frame 101 is provided, in accordance with aspects of the present disclosure. The knockdown bracing runs between the back-right column 113 and back-right column 111 to form an end frame 101. The knockdown bracing comprises a diagonal knockdown brace 120, a top knockdown brace 132, and a bottom knockdown brace 133. In an assembled state, the diagonal knockdown brace 120 runs between the back-right column 113 and the back-right column 111 at an angle, such as 20 degrees, 30 degrees, 40 degrees, or 45 degrees. In an assembled state, the top knockdown brace 132 and bottom knockdown brace 133 are substantially perpendicular to the back-right column 113 and back-right column 111.

The top knockdown brace 132 is secured to the back-right column 113 with a first removable pivot screw 201 and to the back-right column 111 with a second removable pivot screw 202. The first removable pivot screw 201 may pass through an opening in the front-facing side of the back-right column 113, through two openings in either side of the top knockdown brace 132, and thread into an end cap penetrating through the back-facing side of the back-right column 113. The second removable pivot screw 202 may pass through an opening in the front-facing side of the back-right column 111, through two openings in either side of the top knockdown brace 132, and thread into an end cap penetrating through the back-facing side of the back-right column 111. The top knockdown brace 132 is in an assembled state when both the first removable pivot screw 201 and the second removable pivot screw 202 are tightened in place. The assembled state, the top knockdown brace 132 substantially prevents the back-right column 113 and the back-right column 111 from moving laterally towards or away from each other.

The diagonal knockdown brace 120 is secured to the back-right column 113 with a third removable pivot screw 203 and to the back-right column 111 with a fourth removable pivot screw 204. The third removable pivot screw 203 may pass through an opening in the front-facing side of the back-right column 113, through two openings in either side of the diagonal knockdown brace 120, and thread into an end cap penetrating through the back-facing side of the back-right column 113. The fourth removable pivot screw 204 may pass through an opening in the front-facing side of the back-right column 111, through two openings in either side of the diagonal knockdown brace 120, and thread into an end cap penetrating through the back-facing side of the back-right column 111. The diagonal knockdown brace 120 is in an assembled state when both the third removable pivot screw 203 and the fourth removable pivot screw 204 are tightened in place. The assembled state, the diagonal knockdown brace 120 substantially prevents the back-right column 113 and the back-right column 111 from moving laterally towards or away from each other.

The bottom knockdown brace 133 is secured to the back-right column 113 with a fifth removable pivot screw 205 and to the back-right column 111 with a sixth removable pivot screw 206. The fifth removable pivot screw 205 may pass through an opening in the front-facing side of the back-right column 113, through two openings in either side of the bottom knockdown brace 133, and thread into an end cap penetrating through the back-facing side of the back-right column 113. The sixth removable pivot screw 206 may pass through an opening in the front-facing side of the back-right column 111, through two openings in either side of the bottom knockdown brace 133, and thread into an end cap penetrating through the back-facing side of the back-right column 111. The bottom knockdown brace 133 is in an assembled state when both the fifth removable pivot screw 205 and the sixth removable pivot screw 206 are tightened in place. In the assembled state, the bottom knockdown brace 133 substantially prevents the back-right column 113 and the back-right column 111 from moving laterally towards or away from each other.

Figure 3:
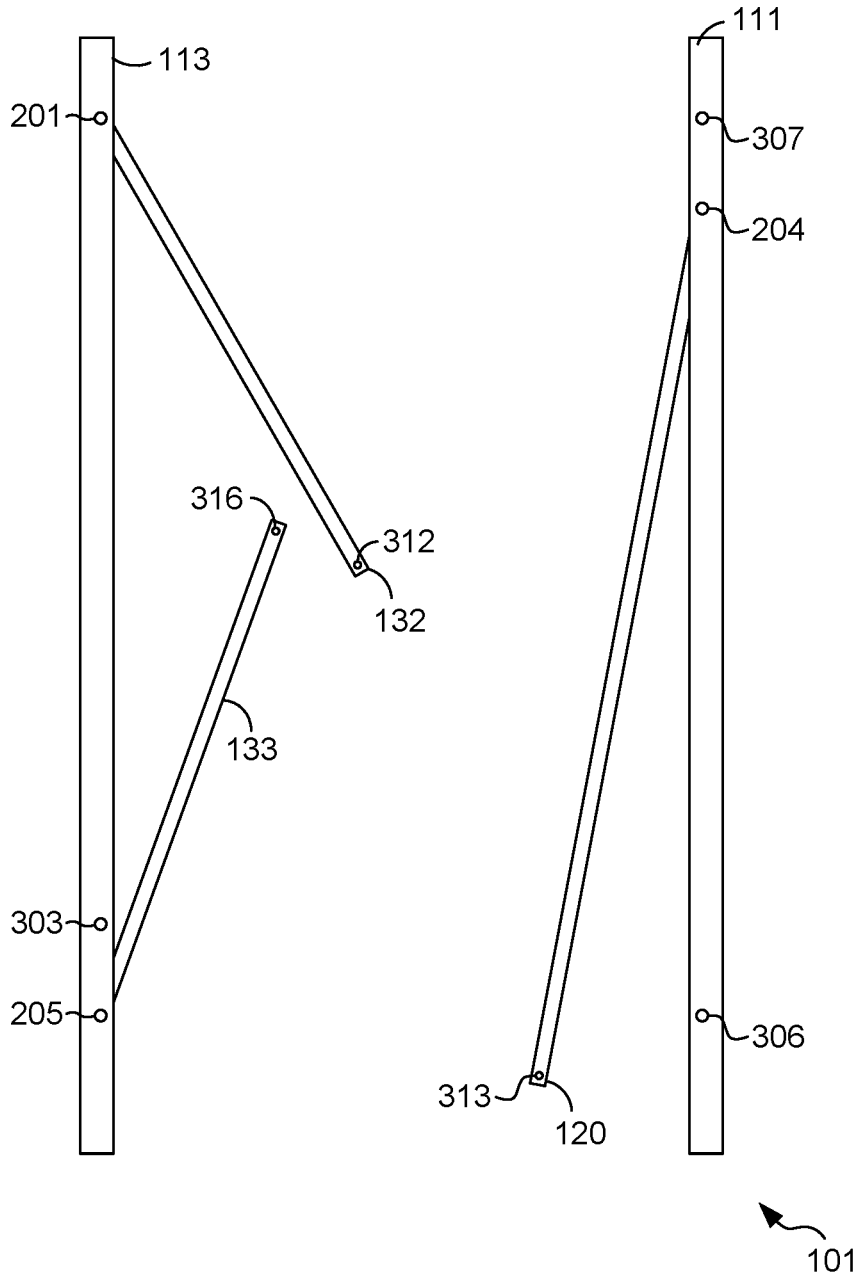
FIG. 3 is a front view of an end frame mid-assembly, in accordance with aspects of the present disclosure.

Turning now to FIG. 3, a front view of an end frame 101 in mid-assembly, in accordance with aspects of the present disclosure. In a knock down state, the knockdown bracing will be parallel with the column and inside an interior volume formed by the column walls. The knockdown position is the unassembled position in which the column may be shipped and/or packaged and shipped. The knockdown bracing transitions from the knockdown state to the assembled state by pivoting on a hinge formed by a pivot screw that connects one end of the knockdown bracing to the column. To complete assembly a pivot screw or other connector may be used to secure the unhinged end of the knockdown bracing to the opposite column.

FIG. 3 shows the end frame 101 in mid-assembly. The top knockdown brace 132 has been pulled out of the interior of back-right column 113 and pivots on the first removable pivot screw 201. Similarly, the bottom knockdown brace 133 has been pulled out of the interior of back-right column 113 and pivots on fifth removable pivot screw 205. The diagonal knockdown brace 120 has been pulled out of the interior of back-right column 111 and pivots on fourth removable pivot screw 204.

In order to transition the top knockdown brace 132 into an assembled position, the top knockdown brace 132 may be rotated upward into a position that is roughly parallel to the ground and perpendicular to the back-right column 113 and the back-right column 111. The second removable pivot screw 202 may then be inserted through an upper brace end opening 312 in the top knockdown brace 132 and upper opening 302 in the back-right column 111.

In order to transition the bottom knockdown brace 133 into an assembled position, the bottom knockdown brace 133 may be rotated downward into a position that is roughly parallel to the ground and perpendicular to the back-right column 113 and the back-right column 111. The sixth removable pivot screw 206 may then be inserted through a lower-brace end opening 316 in the bottom knockdown brace 133 and lower opening 306 in the back-right column 111.

In order to transition the diagonal knockdown brace 120 into an assembled position, the diagonal knockdown brace 120 may be rotated upward into a position that is angled to the ground and runs diagonally between the back-right column 113 and the back-right column 111. The third removable pivot screw 203 may then be inserted through a diagonal-brace end opening 313 in the diagonal knockdown brace 120 and middle opening 303 in the back-right column 113.

Figure 4:
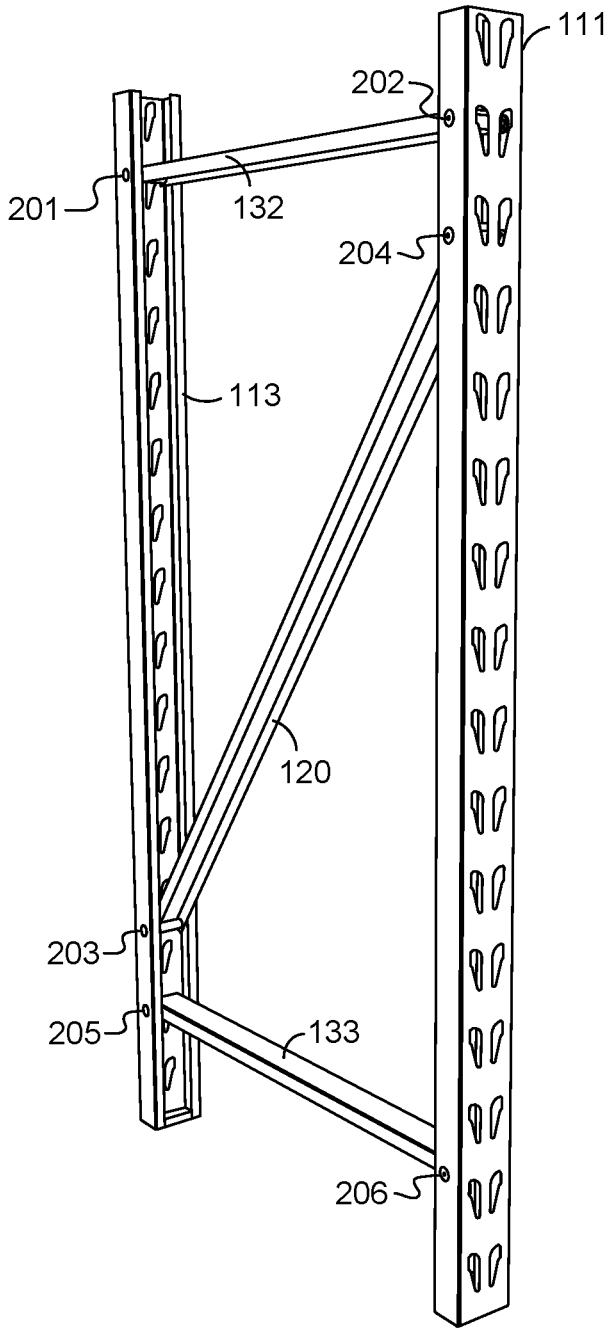
FIG. 4 is a perspective view of an assembled end frame, in accordance with aspects of the present disclosure.

Turning now to FIG. 4, a perspective view of an assembled end frame, in accordance with aspects of the present disclosure. As can be seen, the knockdown bracing (120, 132, and 133) may be formed of a C-channel with an exterior width that is less than the interior width of the interior volume formed by the column walls, which may also be a made from a C-channel.

The top knockdown brace 132 is secured to the back-right column 113 with a first removable pivot screw 201 and to the back-right column 111 with a second removable pivot screw 202. As can be seen, the front end of the top knockdown brace passes into the interior volume of the back-right column 113, where it is secured by the first removable pivot screw 201. The first removable pivot screw 201 may pass through an opening in the front-facing side of the back-right column 113, through two openings in either side of the top knockdown brace 132, and thread into an end cap penetrating through the back-facing side of the back-right column 113.

The diagonal knockdown brace 120 is secured to the back-right column 113 with a third removable pivot screw 203 and to the back-right column 111 with a fourth removable pivot screw 204. As can be seen, the front end of the diagonal knockdown brace 120 passes into the interior volume of the back-right column 113, where it is secured by the third removable pivot screw 203. The third removable pivot screw 203 may pass through an opening in the front-facing side of the back-right column 113, through two openings in either side of the diagonal knockdown brace 120, and thread into an end cap penetrating through the back-facing side of the back-right column 113.

The bottom knockdown brace 133 is secured to the back-right column 113 with a fifth removable pivot screw 205 and to the back-right column 111 with a sixth removable pivot screw 206. As can be seen, the front end of the bottom knockdown brace 133 passes into the interior volume of the back-right column 113, where it is secured by the fifth removable pivot screw 205. The fifth removable pivot screw 205 may pass through an opening in the front-facing side of the back-right column 113, through two openings in either side of the bottom knockdown brace 133, and thread into an end cap penetrating through the back-facing side of the back-right column 113.

Figure 5:
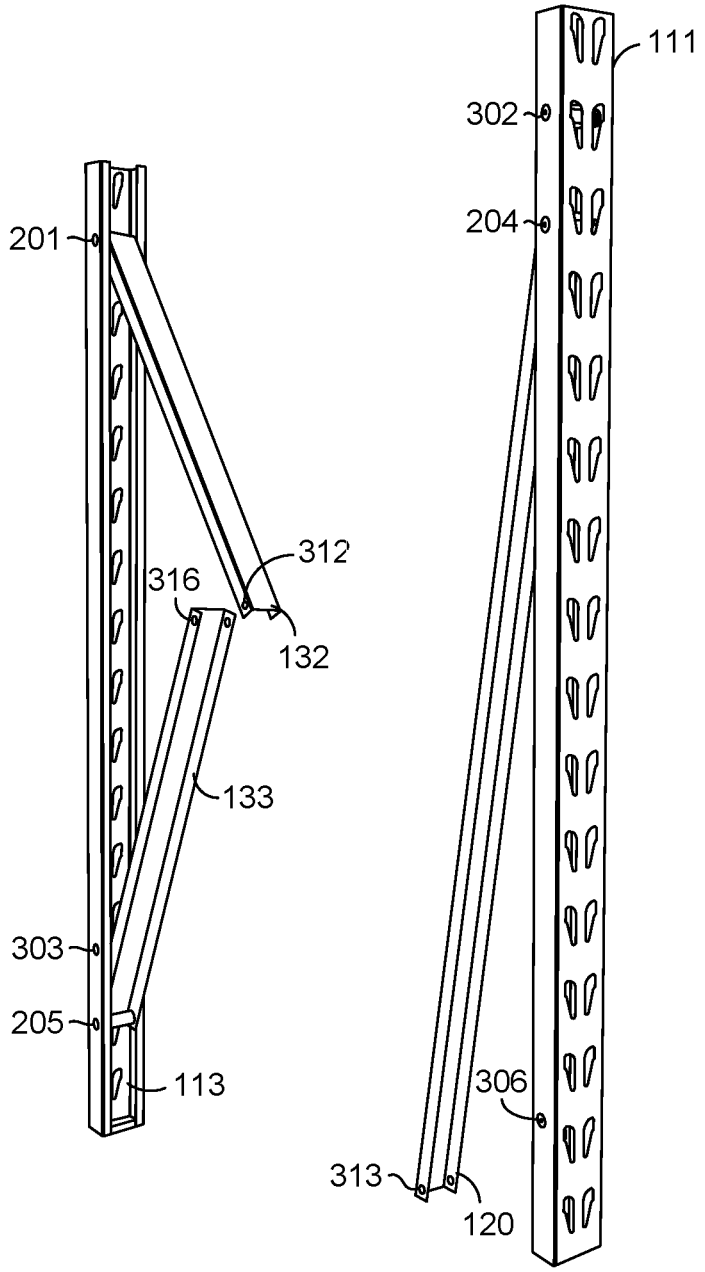
FIG. 5 is a perspective view of an end frame mid-assembly, in accordance with aspects of the present disclosure.

Turning now to FIG. 5, a perspective view of an end frame 101 in mid-assembly, in accordance with aspects of the present disclosure. The features of FIG. 5 have been described previously with reference to FIG. 3, which shows a side view of the end frame 101 in mid-assembly.

Figure 6:
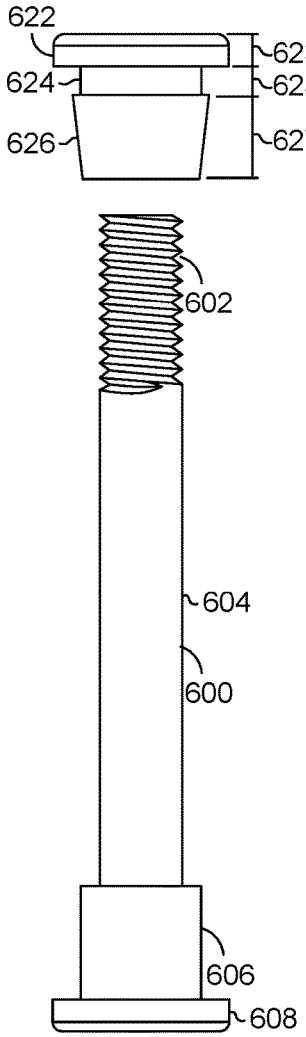
FIG. 6 is a top view of a removable pivot screw and end cap, in accordance with aspects of the present disclosure.

Turning now to FIG. 6, a top view of a removable pivot screw and end cap is shown, in accordance with aspects of the present disclosure. The removable pivot screw 600 may be similar to the first removable pivot screw 201, the second removable pivot screw 202, the third removable pivot screw 203, the fourth removable pivot screw 204, the fifth removable pivot screw 205, and the sixth removable pivot screw 206. Each of these pivot screws may be secured using an end cap similar to the end cap 620. This description of the removable pivot screw 600 and the end cap 620 may be used to define these components throughout.

The removable pivot screw 600 includes a threaded portion 602, a body portion 604, an integral spacer 606, and a head 608. Though not shown in this view, the end cap 620 includes a threaded receptacle sized to receive all or a portion of the threaded portion 602 of the removable pivot screw 600. The end cap 620 includes a cap end 622, a groove 624, and a tapered integral spacer 626. The taper may be helpful for pushing the end cap 620 through an opening in the side wall of a column. The opening in the column may be sized to be slightly smaller than the circumference at the groove and of the integral spacer 626. The cap end 622 may have a first length 623. The groove 624 may be defined by a groove length 625 and a groove depth. The groove depth may be considered the difference between the groove radius and the integral spacer's radius at the end the closest to the groove. The tapered integral spacer 626 has a spacer length 627.

Figure 7:
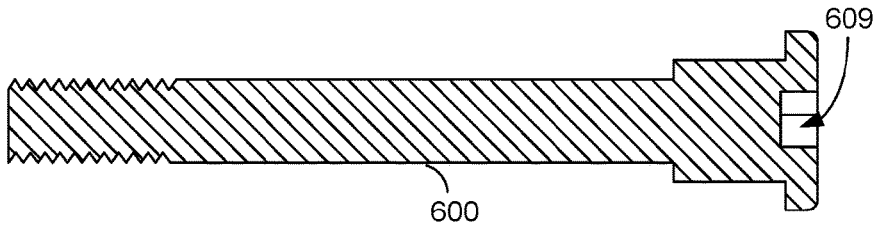
FIG. 7 is a bisected view of a removable pivot screw, in accordance with aspects of the present disclosure.

Turning now to FIG. 7, a bisected view of a removable pivot screw is shown, in accordance with aspects of the present disclosure. The bisected view reveals an opening 609 for an Allen wrench. Aspects are not limited to screws have an Allen head opening.

Figure 8:
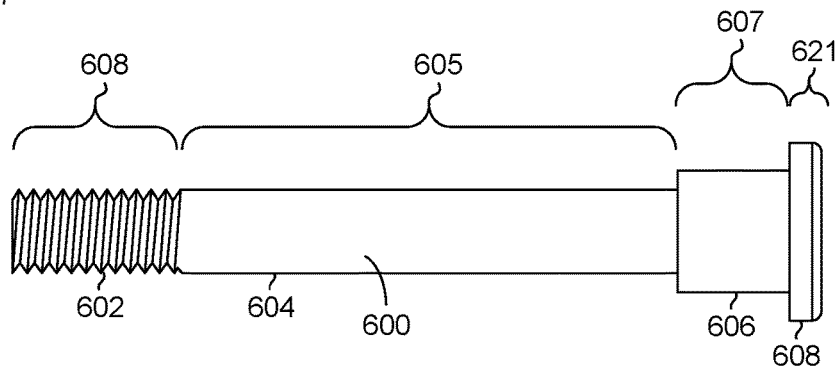
FIG. 8 is a top view of a removable pivot screw, in accordance with aspects of the present disclosure.

Turning now to FIG. 8, a top view of a removable pivot screw is shown, in accordance with aspects of the present disclosure. The threaded portion 602 has a first length 603, the main body portion 604 as a second length 605, the integral spacer 606 as a third length 607, and the end 608 has a fourth length 621. The combined length of the end cap 620 and removable pivot screw 600 may be the combined length of both components minus the depth the threaded portion 602 penetrates into the threaded receptacle of the end cap 620.

Figure 9B:
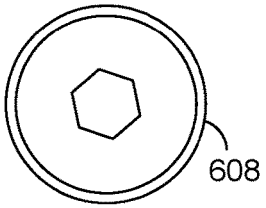
FIG. 9B is an end view of a removable pivot screw or removable end cap, in accordance with aspects of the present disclosure.
Figure 9A:
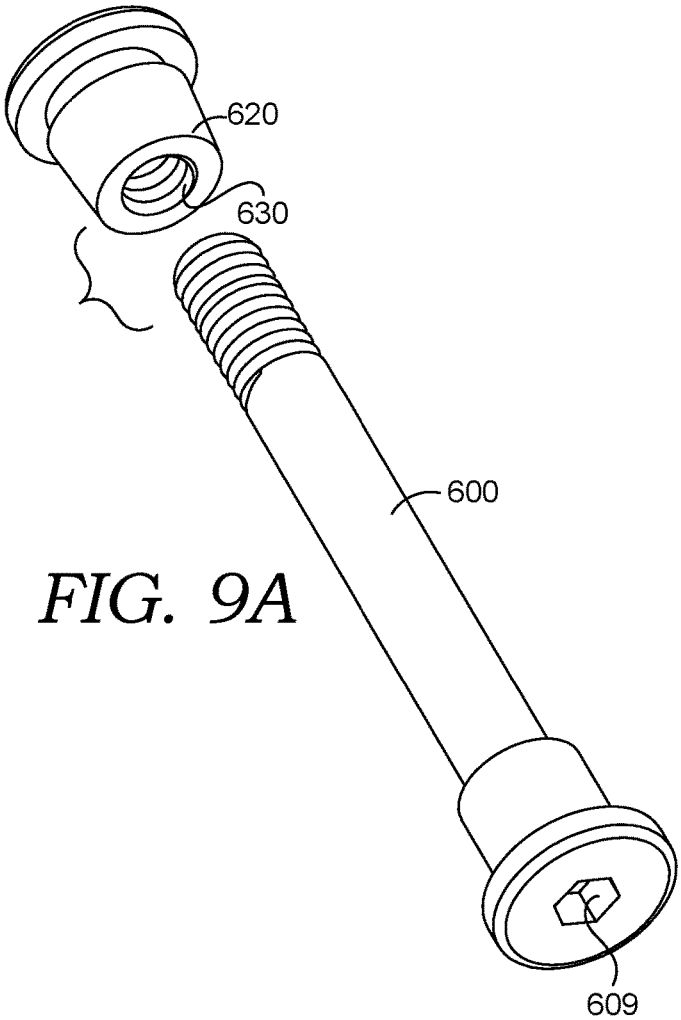
FIG. 9A is a perspective view of a removable pivot screw and end cap, in accordance with aspects of the present disclosure.

Turning now to FIG. 9A, a perspective view of a removable pivot screw and end cap is shown, in accordance with aspects of the present disclosure. These have components have been described previously, however, the threaded receptacle 630 in the end cap 620 and Allen head opening 609 are now visible.

Turning now to FIG. 9B, an end view of a removable pivot screw or removable end cap is shown, in accordance with aspects of the present disclosure. In aspects, the end view of the removable pivot screw 600 and removable end cap 620 are substantially similar. The heads on both components may include an Allen head opening and have substantially the same dimensions.

Figure 9C:
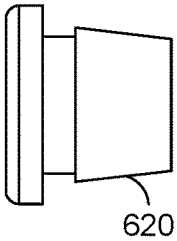
FIG. 9C is a side view of an end cap, in accordance with aspects of the present disclosure.

Turning now to FIG. 9C, a side view of an end cap 620 is shown, in accordance with aspects of the present disclosure. The end cap 620 has been described previously.

Figure 9D:
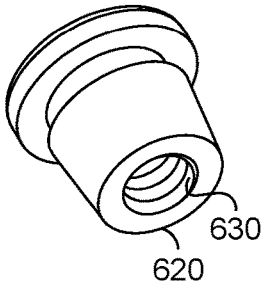
FIG. 9D is a perspective view of an end cap, in accordance with aspects of the present disclosure.

Turning now to FIG. 9D, a perspective view of an end cap is shown, in accordance with aspects of the present disclosure. The end cap 620 has been described previously.

Figure 9E:
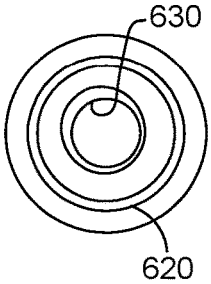
FIG. 9E is an inward facing-end view of an end cap, in accordance with aspects of the present disclosure.

Turning now to FIG. 9E, an inward facing-end view of an end cap is shown, in accordance with aspects of the present disclosure. The end cap 620 has been described previously.

Figure 10:
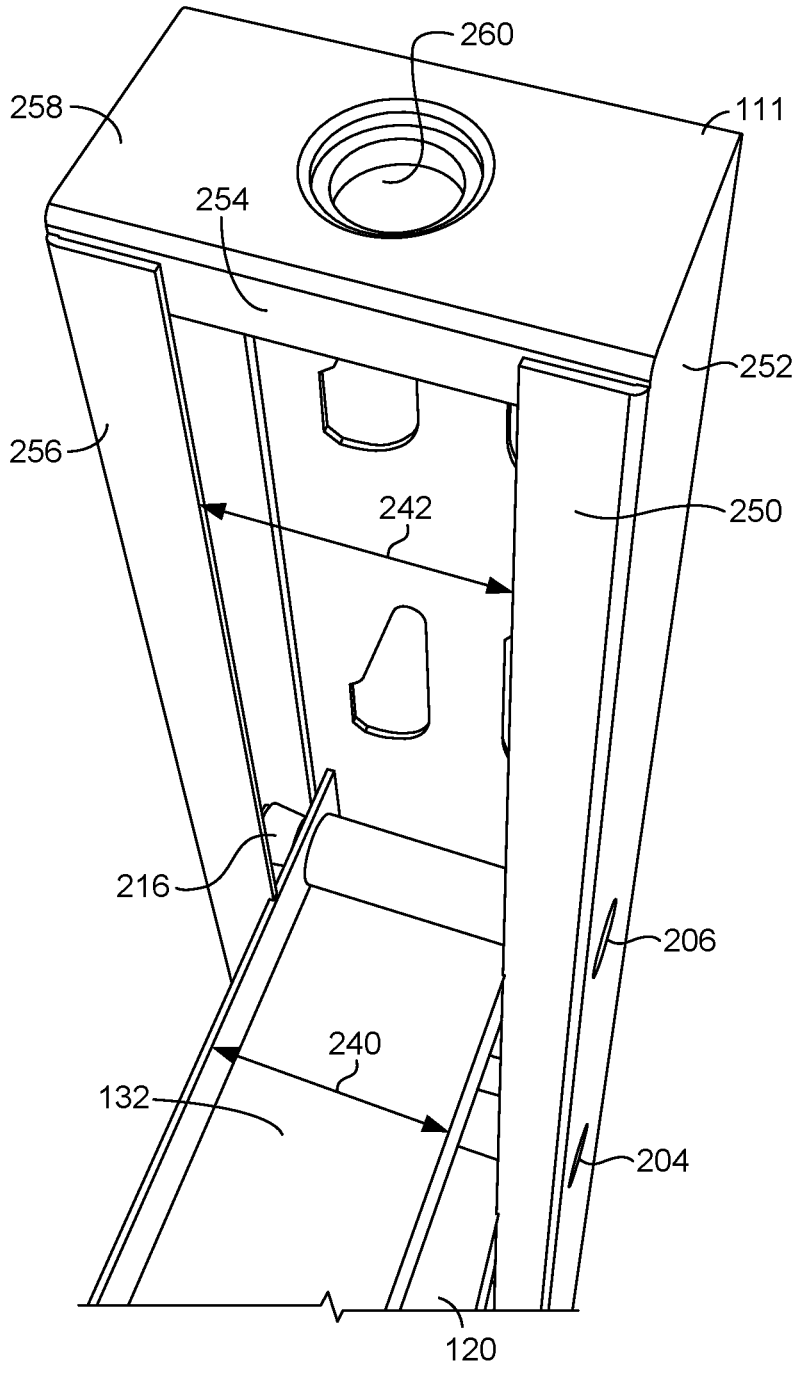
FIG. 10 is a detailed perspective view of a bottom knockdown brace connected in an end frame, in accordance with aspects of the present disclosure.

Turning now to FIG. 10, a bottom view of the shelving unit is shown, in accordance with aspects of the present disclosure. As can be seen, the back-right column 111 includes an interior volume into which the bottom knockdown brace 133 fits. The width 242 of the opening into the interior volume is defined by a right flange 250 and a left flange 256. The width 242 is slightly larger than the exterior width 240 of the bottom knockdown brace 133. The integral spacer 216 of the end cap extends into the interior volume approximately the same distance as the left flange 256. In this way, integral spacer 216 helps keep the bottom knockdown brace 133 roughly perpendicular to the back-right column 111. The bottom of the back-right column 111 may include a bottom plate 258 with a circular opening 260. The bottom plate 258 may include a lip 254 which may add rigidity to the bottom plate 258.

Figure 11:
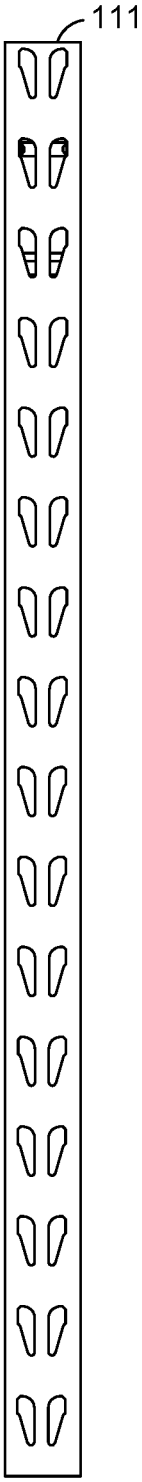
FIG. 11 is a side view of an end frame, in accordance with aspects of the present disclosure.

Turning now to FIG. 11, a front view of an end frame, in accordance with aspects of the present disclosure. The front-side of back-right column 111 includes pairs of apertures, such as aperture 710, which serve as a connection point for the horizontal shelf-support beams (not shown). Pins in the backside of the shelf-support beams may slide into the wider top portion of the aperture 710. The pin head may fit through the wider top portion of the aperture 710, but not the lower portion. When pushed down, the exterior of the pin's rod may fit snugly into the bottom of the apertures 710. The head on the pin is wider than the opening at the bottom of the aperture 710, which holds the horizontal shelf-support beams securely to the front-side of back-right column 111.

Figure 12:
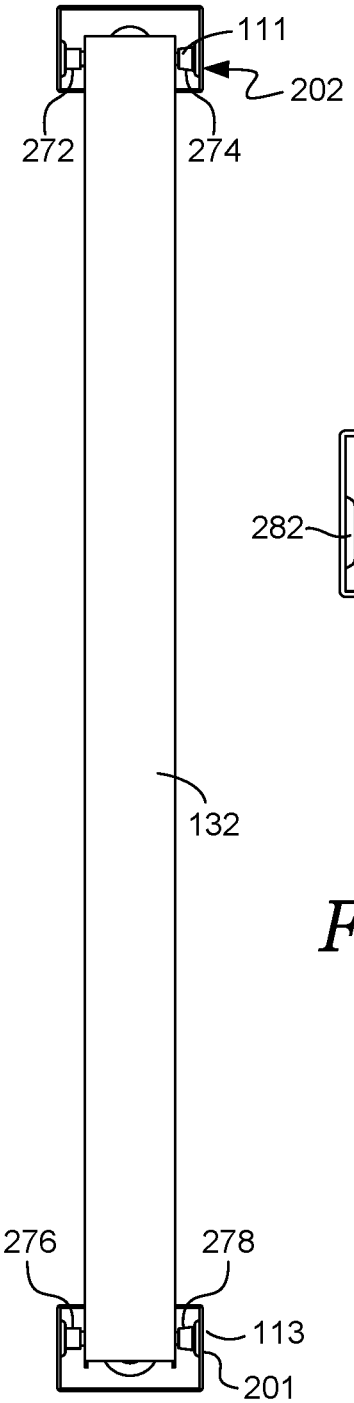
FIG. 12 is a top view of an end frame, in accordance with aspects of the present disclosure.

Turning now to FIG. 12, a top view of an end frame, in accordance with aspects of the present disclosure. The top knockdown brace 132 is secured to the back-right column 113 with a first removable pivot screw 201 and to the back-right column 111 with a second removable pivot screw 202. As can be seen, the front end of the top knockdown brace passes into the interior volume of the back-right column 113, where it is secured by the first removable pivot screw 201. An exterior width 830 of the top knockdown brace 132 is smaller than a width 832 of the interior-facing opening of in the back-right column 111. The back end of the top knockdown brace 132 passes into the interior volume of the back-right column 111, where it is secured by the second removable pivot screw 202. Though not shown, the bottom knockdown brace 133 and diagonal knockdown brace 120 have similar dimensions where the exterior width of the knockdown brace is smaller than a corresponding opening the columns.

Figure 13:
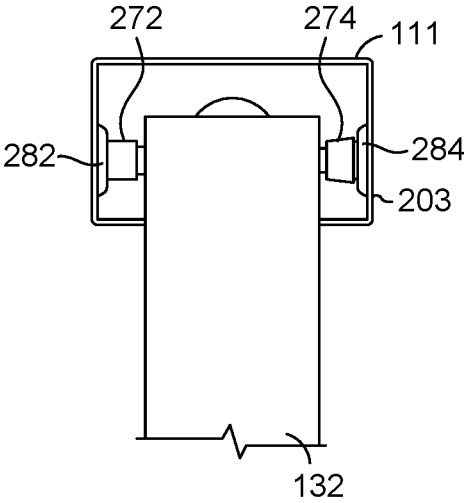
FIG. 13 is a top view of a top knockdown brace in an end frame, in accordance with aspects of the present disclosure.

Turning now to FIG. 13, a top view of a top knockdown brace connected to an end frame, in accordance with aspects of the present disclosure. The third removable pivot screw 203 may pass through an opening in the front-facing side of the back-right column 111, through two openings in either side of the top knockdown brace 132, and thread into an end cap penetrating through the back-facing side of the back-right column 111. An integral spacer 812 on the first removable pivot screw 201 fits between a first exterior wall of a first side of the top knockdown brace 132 and an interior facing wall of first indentation 910. The first indentation 910 is sized to receive a head on the third removable pivot screw 203, such that an interior-facing side of the third removable pivot screw 203 is substantially flush with the exterior-facing side of the first indentation 910. The first indentation 910 is also sized so that, when installed, the exterior facing side of on the third removable pivot screw 203 is substantially flush with the exterior side wall 913 of the back-right column 111. Though not shown, the same connection details may be present where the first removable pivot screw 201, the second removable pivot screw 202, the fourth removable pivot screw 204, the fifth removable pivot screw 205, and the sixth removable pivot screw 206 are installed.

As shown in more detail with reference to FIGS. 14-17, the end cap's integral spacer 820 fits between a second exterior wall of a second side of the top knockdown brace 132 and a second interior facing wall of the second indentation 920. The second indentation 920 is sized to receive a head on the third end cap 903, such that an interior-facing side of the third end cap 903 is substantially flush with the exterior-facing side of the second indentation 920. The second indentation 920 is also sized so that, when installed, the exterior facing side of on the third end cap 903 is substantially flush with the exterior side wall 914 of the back-right column 111. Though not shown, the same connection details may be present where the first end cap, the second end cap, the fourth end cap, the fifth end cap, and the sixth end cap are installed. The first, second, third, fourth, fifth, and sixth end caps are matched with their corresponding removable pivot screws when installed.

The first, second, third, fourth, fifth, and sixth end caps are matched with their corresponding removable pivot screws when installed. The end caps may be preinstalled within their respective openings during the manufacturing process (rather than at installation). The end caps may be forced through the openings, such that a groove in the end cap fits against an interior side of an opening in the knockdown bracing's side wall. The groove width may be slightly larger than a thickness of a column's side wall. In this way, a groove exterior surface may be in contact with an opening's inward facing portion.

Figure 14:
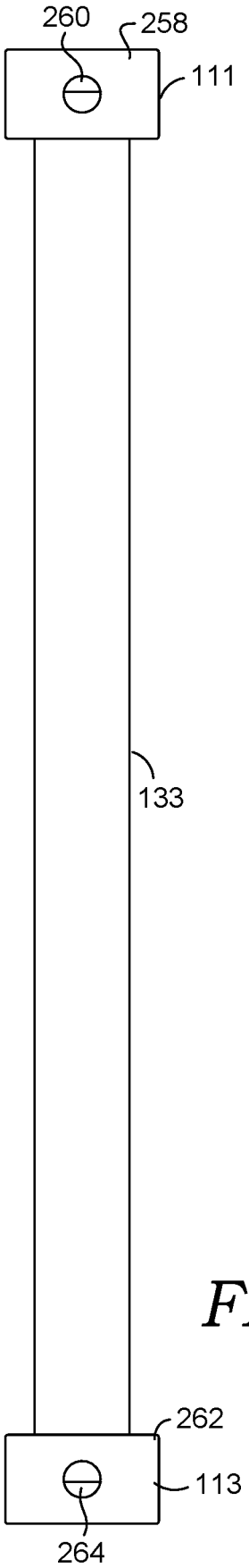
FIG. 14 is a bottom view of an end frame, in accordance with aspects of the present disclosure.

Turning now to FIG. 14, a bottom view of an end frame is shown, in accordance with aspects of the present disclosure. From the bottom view, it can be seen that bottom knockdown brace 133 spans between the back-right column 113 and the back-right column 111. A support plate 611 with opening 612 forms the bottom end of the back-right column 111. A support plate 613 with opening 614 forms the bottom end of the back-right column 113.

Figure 15:
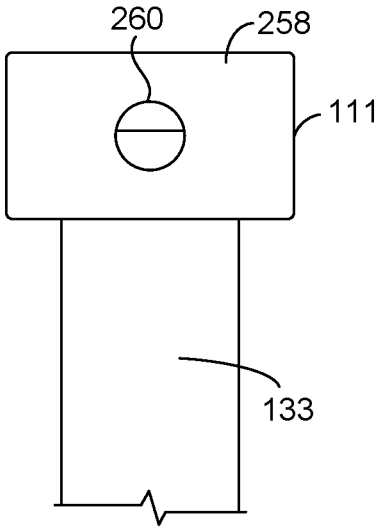
FIG. 15 a bottom view of a bottom knockdown brace in an end frame, in accordance with aspects of the present disclosure.

Turning now to FIG. 15, a bottom view of a bottom knockdown brace in an end frame is shown, in accordance with aspects of the present disclosure. The components of FIG. 15 have been described in FIG. 14.

The technology described herein has been described in relation to particular aspects, which are intended in all respects to be illustrative rather than restrictive. While the technology described herein is susceptible to various modifications and alternative constructions, certain illustrated aspects thereof are shown in the drawings and have been described above in detail. It should be understood, however, that there is no intention to limit the technology described herein to the specific forms disclosed, but on the contrary, the intention is to cover all modifications, alternative constructions, and equivalents falling within the spirit and scope of the technology described herein.

What is claimed is:

1. A shelving unit comprising:

a right-end frame comprising a front right column removeably connected to a back right column with right-end knockdown bracing when in an assembled state, wherein the right-end knockdown bracing includes a top knockdown brace and a bottom knockdown brace, wherein the top knockdown brace is connected to the front right column with a top pivot connection, and wherein the bottom knockdown brace is connected to the front right column with a bottom pivot connection, wherein, when in an unassembled state, the top and bottom knockdown braces are able to pivot from a first position entirely within an interior volume of the front right column to a second position that is substantially perpendicular to the front right column in the assembled state;

a left-end frame comprising a front left column removeably connected to a back left column with left-end knockdown bracing; and a shelf comprising a front shelf-support beam removeably connected to the front right column and the front left column, a back shelf-support beam removeably connected to the back right column and the back left column.

2. The shelving unit of claim 1, wherein the right-end knockdown bracing includes a diagonal knockdown brace connected to the back right column or the back right column, wherein the diagonal knockdown brace is connected to the back right column with a middle pivot connection.

3. The shelving unit of claim 1, wherein the right-end knockdown bracing includes a top knockdown brace and a bottom knockdown brace, wherein the top knockdown brace is connected to the back right column with a top pivot connection, and wherein the bottom knockdown brace is connected to the back right column with a bottom pivot connection.

4. The shelving unit of claim 3, wherein the right-end knockdown bracing includes a diagonal knockdown brace connected to the front right column or the front right column, wherein the diagonal knockdown brace is connected to the front right column with a middle pivot connection.

5. The shelving unit of claim 1, wherein the top pivot connection is formed by a removable pivot screw penetrating a first side wall of the front right column and joined to a removable end cap penetrating a second side wall of the front right column.

6. The shelving unit of claim 5, wherein the removable pivot screw is joined to the removable end cap by inserting a threaded end of the removable pivot screw into a threaded receptacle in the removable end cap.

7. The shelving unit of claim 5, wherein the removable pivot screw includes an integral spacer.

8. The shelving unit of claim 5, wherein the removable end cap includes an integral spacer.

9. A shelving end frame comprising:

a first column removeably connected to a second column with a top knockdown brace, a bottom knockdown brace, and a diagonal knockdown brace when the shelving end frame is in an assembled state, wherein the top knockdown brace is connected to the first column with a top pivot connection, and wherein the bottom knockdown brace is connected to the first column with a bottom pivot connection, and wherein the diagonal knockdown brace is connected to the second column with a pivot connection wherein, when in an unassembled state, the top and bottom knockdown braces are able to pivot from a first position entirely within an interior volume of the first column to a second position that is substantially perpendicular to the first column in the assembled state.

10. The shelving end frame of claim 9, wherein the top pivot connection is formed by a removable pivot screw penetrating a first side wall of the first column and joined to a removable end cap penetrating a second side wall of the first column.

11. The shelving end frame of claim 10, wherein the pivot connection is formed by a removable pivot screw penetrating a first side wall of the second column and joined to a removable end cap penetrating a second side wall of the second column.

12. The shelving end frame of claim 11, wherein the removable pivot screw is joined to the removable end cap by inserting a threaded end of the removable pivot screw into a threaded receptacle in the removable end cap.

13. The shelving end frame of claim 12, wherein the removable pivot screw includes an integral spacer.

14. The shelving end frame of claim 12, wherein the removable end cap includes an integral spacer.

15. The shelving end frame of claim 9, wherein, when unassembled, the diagonal knockdown brace is able to pivot from a first position within an interior volume of the second column to a second position that is at, substantially, a 30 degree angle to the second column.

16. A unassembled shelving end frame comprising:

a first column with a top knockdown brace and a bottom knockdown brace, wherein the top knockdown brace is connected to the first column with a top pivot connection, and wherein the bottom knockdown brace is connected to the first column with a bottom pivot connection, wherein, when in an unassembled state, the top and bottom knockdown braces are able to pivot from a first position entirely within an interior volume of the first column to a second position that is substantially perpendicular to the first column in an assembled state; and a second column with a diagonal knockdown brace and wherein the diagonal knockdown brace is connected to the second column with a middle pivot connection wherein, when in the unassembled state, the diagonal knockdown brace is able to pivot from a first position entirely within an interior volume of the second column to a second position that is substantially perpendicular to the second column in the assembled state where the top knockdown brace, the bottom knockdown brace, and the diagonal knockdown brace connect the first column and the second column together.

17. The unassembled shelving end frame of claim 16, wherein the first column includes a middle attachment point adapted to receive the diagonal knockdown brace, wherein the middle attachment point is located between the top pivot connection and the bottom pivot connection.

18. The unassembled shelving end frame of claim 16, wherein the second column includes a top attachment point adapted to receive the top knockdown brace and a bottom attachment point adapted to receive the bottom knockdown brace, wherein the middle pivot connection is located between the top attachment point and the bottom attachment point.

* * * * *